US010634015B2

(12) United States Patent
Son et al.

(10) Patent No.: US 10,634,015 B2
(45) Date of Patent: Apr. 28, 2020

(54) CONTINUOUS VARIABLE VALVE LIFT APPARATUS AND ENGINE PROVIDED WITH THE SAME AND VARYING VALVE LIFT ACCORDING TO OPERATION CONDITIONS OF ENGINE

(71) Applicant: Hyundai Motor Company, Seoul (KR)

(72) Inventors: You Sang Son, Suwon-si (KR); Kyoung Pyo Ha, Seongnam-si (KR); Back Sik Kim, Osan-si (KR); Kiyoung Kwon, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 1183 days.

(21) Appl. No.: 14/955,290

(22) Filed: Dec. 1, 2015

(65) Prior Publication Data

US 2017/0081988 A1 Mar. 23, 2017

(30) Foreign Application Priority Data

Sep. 21, 2015 (KR) ..... 10-2015-0133337

(51) Int. Cl.

| | |
|---|---|
| ***F01L 1/26*** | (2006.01) |
| ***F01L 1/18*** | (2006.01) |
| ***F01L 1/053*** | (2006.01) |
| ***F01L 13/00*** | (2006.01) |
| ***F01L 1/047*** | (2006.01) |
| ***F01L 1/24*** | (2006.01) |

(52) U.S. Cl.

CPC ..... *F01L 1/267* (2013.01); *F01L 1/047* (2013.01); *F01L 1/053* (2013.01); *F01L 1/18* (2013.01); *F01L 1/185* (2013.01); *F01L 13/0026* (2013.01); *F01L 13/0063* (2013.01); *F01L 1/2405* (2013.01); *F01L 2105/00* (2013.01)

(58) Field of Classification Search

CPC ... F01L 13/0026; F01L 13/0063; F01L 1/047; F01L 1/053; F01L 1/18; F01L 1/185; F01L 1/2405; F01L 1/267; F01L 2105/00; F01L 2820/03

USPC ..... 123/90.16, 90.39, 90.27, 90.31, 90.44, 123/90.6

See application file for complete search history.

(56) References Cited

U.S. PATENT DOCUMENTS

| | | | | |
|---|---|---|---|---|
| 8,544,429 | B2 | 10/2013 | Nakamura et al. | |
| 2017/0081987 | A1* | 3/2017 | Son | F01L 1/047 |

FOREIGN PATENT DOCUMENTS

| | | | |
|---|---|---|---|
| JP | 5516493 | B2 | 4/2014 |
| JP | 2014-77390 | A | 5/2014 |
| JP | 2015-117692 | A | 6/2015 |
| KR | 10-2010-0047673 | A | 5/2010 |

* cited by examiner

*Primary Examiner* — Patrick Hamo
*Assistant Examiner* — Paul W Thiede
(74) *Attorney, Agent, or Firm* — Morgan, Lewis & Bockius LLP

(57) ABSTRACT

A continuously variable valve lift apparatus may include a camshaft, a cam portion on which two cams are formed and on which a rotation member is formed between the cams, a slider housing into which the rotation member is rotatably inserted, and rotatable around a pivot shaft, a control portion configured to selectively change a position of the slider housing, an output portion contacting the cams, rotatable around the pivot shaft and on which a valve shoe is formed, and a valve device configured to be driven by the valve shoe.

14 Claims, 8 Drawing Sheets

CONTINUOUS VARIABLE VALVE LIFT APPARATUS AND ENGINE PROVIDED WITH THE SAME AND VARYING VALVE LIFT ACCORDING TO OPERATION CONDITIONS OF ENGINE

CROSS-REFERENCE TO RELATED APPLICATION

The present application claims priority to Korean Patent Application No. 10-2015-0133337 filed Sep. 21, 2015, the entire contents of which is incorporated herein for all purposes by this reference.

BACKGROUND OF THE INVENTION

Field of the Invention

The present invention relates to a continuous variable valve lift apparatus and an engine provided with the same. More particularly, the present invention relates to a continuous variable valve lift apparatus an engine provided with the same which may vary valve lift according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve lift apparatus and an engine provided with the same which may vary valve lift according to operation conditions of an engine, with a simple construction.

According to various aspects of the present invention, a continuously variable valve lift apparatus may include a camshaft, a cam portion on which two cams are formed and on which a rotation member is formed between the cams, a slider housing into which the rotation member is rotatably inserted, and rotatable around a pivot shaft, a control portion configured to selectively change a position of the slider housing, an output portion contacting the cams, rotatable around the pivot shaft and on which a valve shoe is formed, and a valve device configured to be driven by the valve shoe.

The rotation member and the cams of the cam portion may be integrally formed.

A camshaft hole may be formed on the camshaft, and a pin hole may be formed on the cam portion, the continuously variable valve lift apparatus may further include a pin slider rotatably disposed within the pin hole and on which a slider hole is formed, and a connecting pin connected to the camshaft hole and slidably inserted into the slider hole.

The continuously variable valve lift apparatus may further include a bearing inserted between the rotation member and the slider housing.

The output portion is disposed as a pair, and the valve device may be disposed as a pair and each valve device may include a swing arm roller contacting each valve shoe.

The output portion may include an output roller contacting each cam.

The control portion may include an eccentric shaft connected to the slider housing.

According to various aspects of the present invention, an engine may include a camshaft, a cam portion on which two cams are formed and on which a rotation member is formed between the cams, a slider housing into which the rotation member is rotatably inserted, and rotatable around a pivot shaft, a control portion configured to selectively change a position of the slider housing, an output portion contacting the cams, rotatable around the pivot shaft and on which a valve shoe is formed, and a valve device configured to be driven by the valve shoe.

The engine may further include a bearing inserted between the rotation member and the slider housing.

As described above, a continuous variable valve lift apparatus according to various embodiments of the present invention may vary valve lift according to operation conditions of an engine, with a simple construction.

The continuous variable valve lift apparatus according to various embodiments of the present invention may reduce duration in minimum valve lift comparing to general continuous variable valve lift apparatuses.

The continuous variable valve lift apparatus according to various embodiments of the present invention may advance closing timing of an intake valve so that may reduce pumping loss and enhance fuel economy.

The continuous variable valve lift apparatus according to various embodiments of the present invention may be reduced in size and thus the entire height of a valve train may be reduced.

Since the continuous variable valve lift apparatus may be applied to an existing engine without excessive modification, thus productivity may be enhance and production cost may be reduced.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogenpowered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
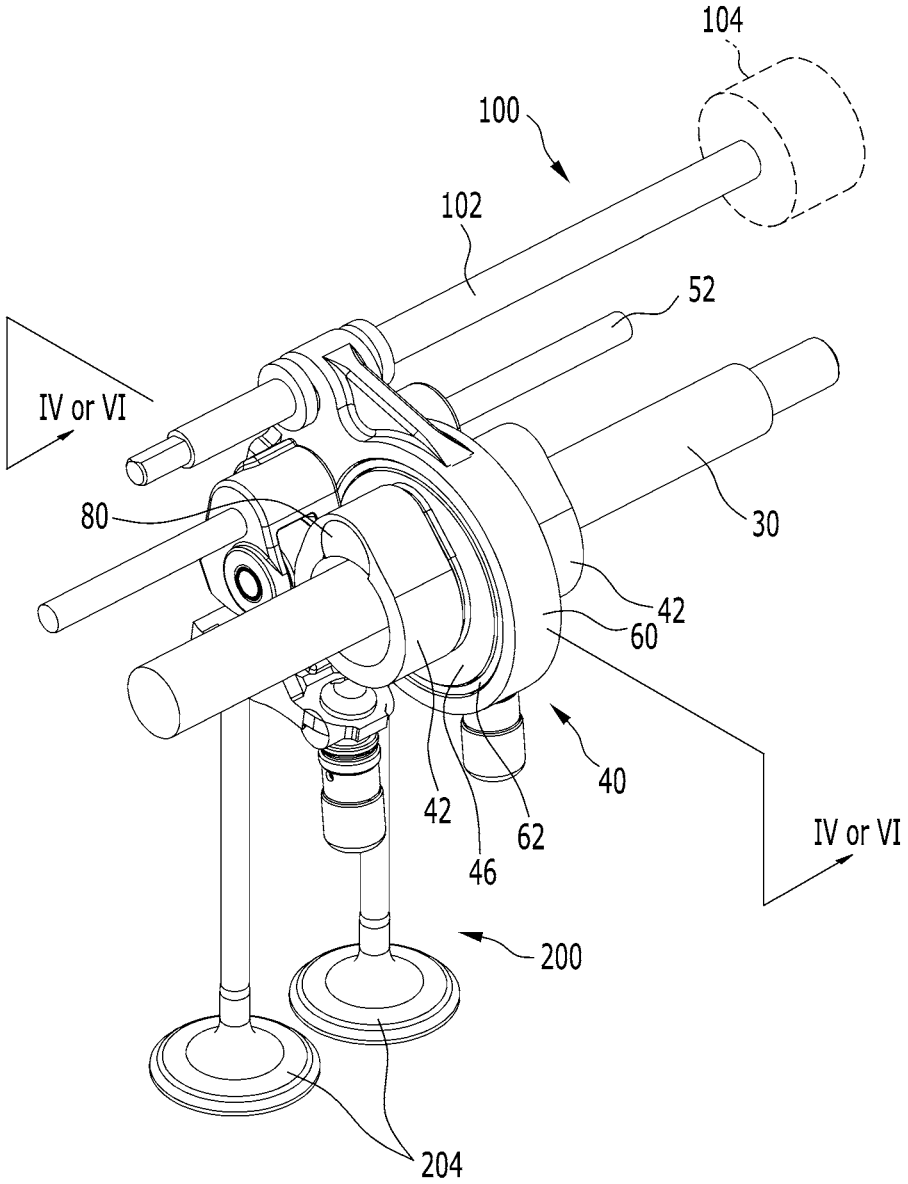
FIG. 1 is a perspective view of an exemplary continuous variable valve lift apparatus according to the present invention.
Figure 2:
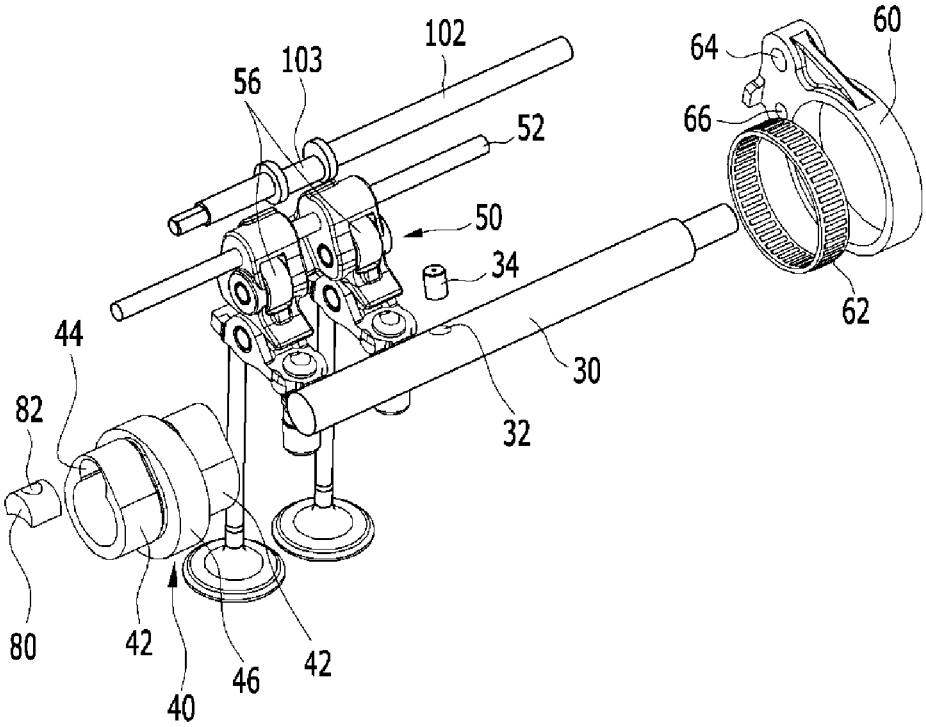
FIG. 2 is an exploded perspective view of the exemplary continuous variable valve lift apparatus according to the present invention.

FIG. 1 is a perspective view of a continuous variable valve lift apparatus according to various embodiments of the present invention and FIG. 2 is an exploded perspective view of a continuous variable valve lift apparatus according to various embodiments of the present invention.

Figure 3:
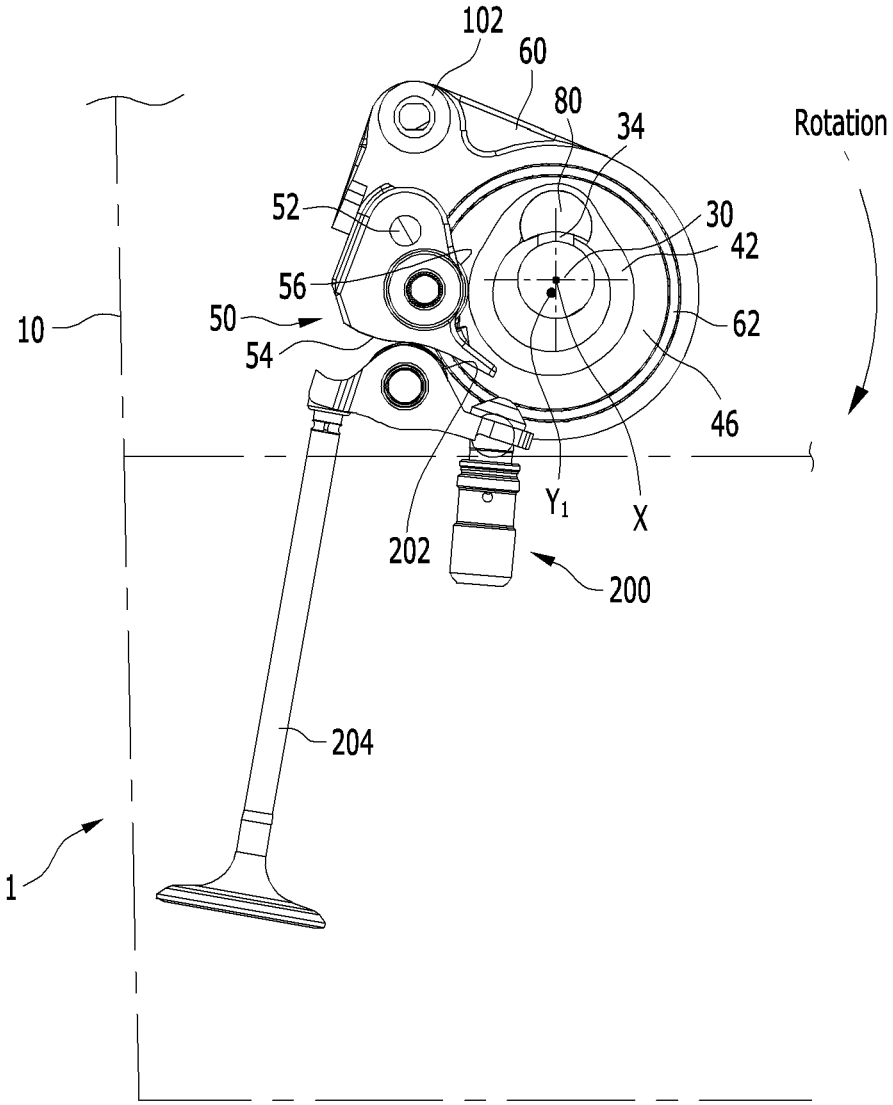
FIG. 3 is a front view of the exemplary continuous variable valve lift apparatus according to the present invention operated in a high lift mode.
Figure 4:
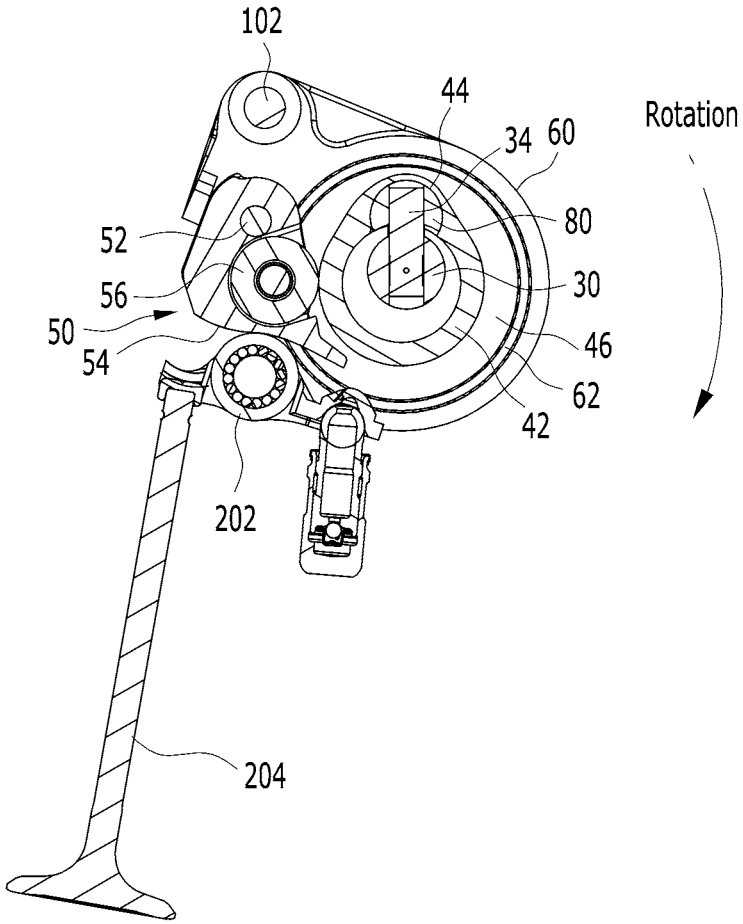
FIG. 4 is a cross-sectional view along line IV-IV of FIG. 1 describing the exemplary continuously variable valve lift apparatus according to the present invention operated in the high lift mode.

FIG. 3 is a front view of a continuous variable valve lift apparatus according to various embodiments of the present invention operated in high lift mode and FIG. 4 is a cross-sectional view along line IV-IV of FIG. 1 describing a continuously variable valve lift apparatus according to various embodiments of the present invention operated in high lift mode.

Referring to FIG. 1 to FIG. 4, an engine 1 according to various embodiments of the present invention includes a cylinder head 10 and a continuous variable valve lift apparatus mounted to the cylinder head 10. In the detailed description and claims, the cylinder head 10 is interpreted as including a cam carrier.

The continuously variable valve lift apparatus according to various embodiments of the present invention may include a camshaft 30, a cam portion 40 of which two cams 42 are formed thereto and of which a rotation member 46 is formed between the cams 42, a slider housing 60 of which the rotation member 46 is rotatably inserted thereto and rotatable around a pivot shaft 52, a control portion 100 selectively changing a position of the slider housing 60, an output portion 50 contacting to the cams 42, rotatable around the pivot shaft 52 and of which a valve shoe 54 is formed thereto and a valve device 200 configured to be driven by the valve shoe 54.

The rotation member 46 and the cams 42 of the cam portion 40 may be integrally formed.

A camshaft hole 32 is formed to the camshaft 30 and a pin hole 44 is formed to the cam portion 40.

A pin slider 80 where a slider hole 82 is formed thereto is rotatably disposed within the pin hole 44, and a connecting pin 34 is connected to the camshaft hole 32 and slidably inserted into the slider hole 82.

A bearing 62 is inserted between the rotation member 46 and the slider housing 60. Thus, rotation of the rotation member 46 may be easily performed. In the drawings, the bearing 62 is depicted as a needle bearing, however it is not limited thereto. On the contrary, various bearings such as a ball bearing, a roller bearing and so on may be applied thereto.

The output portion 50 is disposed as a pair. And the valve device 200 is disposed as a pair and each valve device 200 includes a swing arm roller 202 contacting each valve shoe 54 and a valve 204.

The output portion 50 includes an output roller 56 contacting to each cam 42.

The control portion 100 includes an eccentric shaft 102 connected to the slider housing 60. A control motor or an actuator 104 selectively rotates the eccentric shaft 102 for adjusting a position of the slider housing 60.

A control hole 64 is formed to the slider housing 60 and the eccentric shaft 102 is inserted into the control hole 64. And a rotation hole 66 is formed to the slider housing 60 and the pivot shaft 52 is inserted into the rotation hole 66.

An eccentric rod 103 is formed to the eccentric shaft 102 and the eccentric rod 103 is rotatably inserted into the control hole 64 of the slider housing 60. And according to rotation of the eccentric shaft 102, the slider housing 60 rotates around the rotation hole 66.

Figure 5:
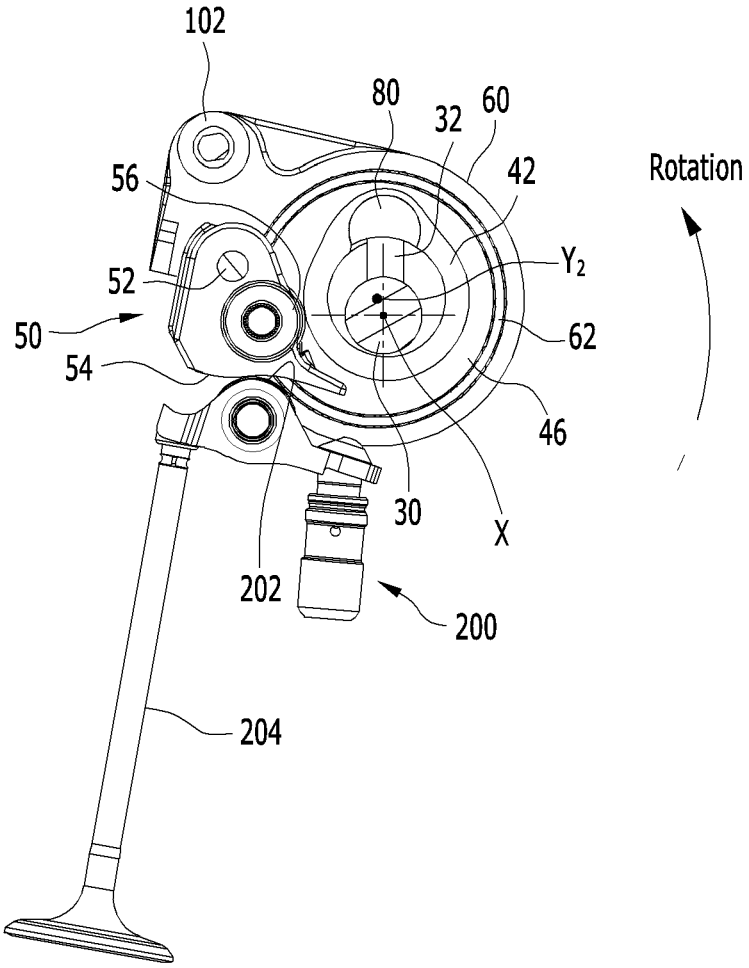
FIG. 5 is a front view of the exemplary continuous variable valve lift apparatus according to the present invention operated in a low lift mode.
Figure 6:
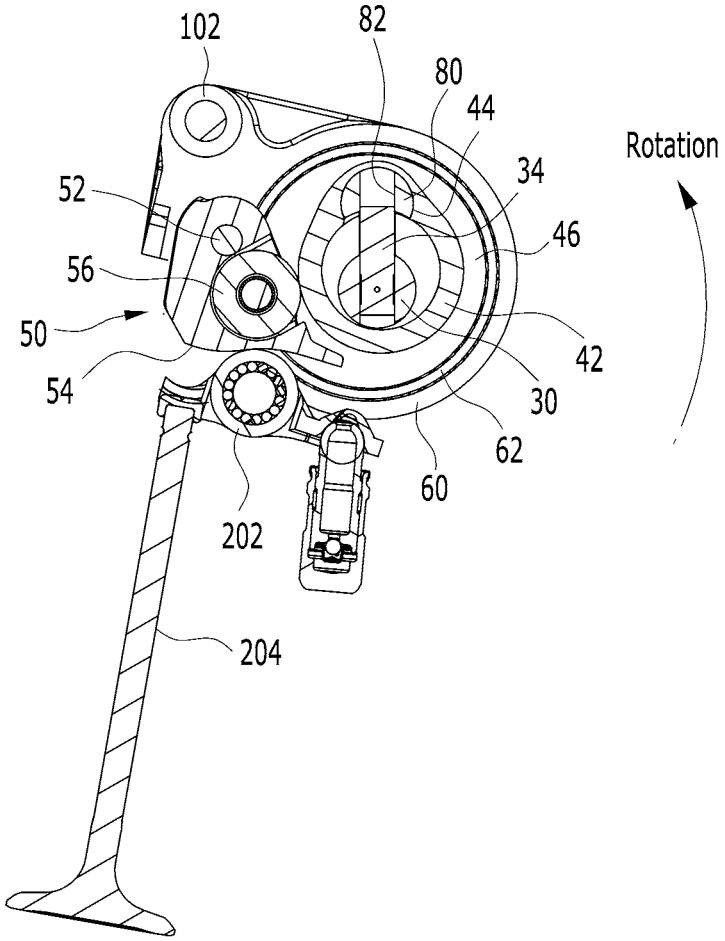
FIG. 6 is a cross-sectional view along line VI-VI of FIG. 1 describing the exemplary continuously variable valve lift apparatus according to the present invention operated in the low lift mode.
Figure 7:
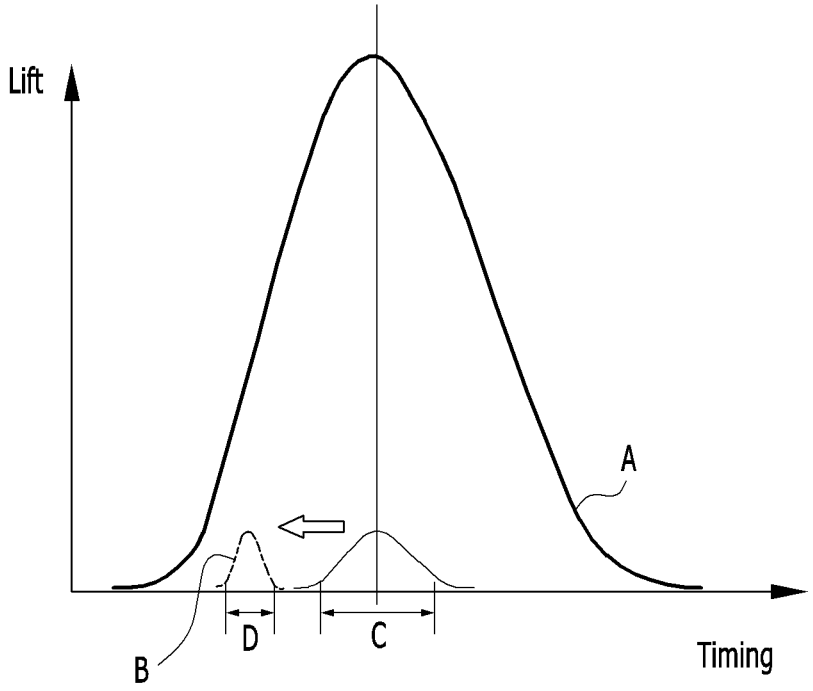
FIG. 7 is a graph of a valve profile of the exemplary continuous variable valve lift apparatus according to the present invention.

FIG. 5 is a front view of a continuous variable valve lift apparatus according to various embodiments of the present invention operated in low lift mode, FIG. 6 is a cross-sectional view along line VI-VI of FIG. 1 describing a continuously variable valve lift apparatus according to various embodiments of the present invention operated in low lift mode and FIG. 7 is a graph of a valve profile of a continuous variable valve lift apparatus according to various embodiments of the present invention.

Hereinafter, referring to FIG. 1 to FIG. 7, operations of the continuously variable valve lift apparatus according to various embodiments of the present invention will be described.

When rotation centers of the camshaft 30 and the cam portion 40 are coincident, the valve 204 realizes a predetermined valve lift profile.

According to engine operation states, the ECU transmits control signals to the motor 104 of the control portion 100 to change the relative position of the slider housing 60.

As shown FIG. 3 and in FIG. 4, for example, in high lift mode requiring high power, the slider housing 60 rotates in a clockwise direction around the pivot shaft 52 according to the operation of the control portion 100. Thus, the relative position of the slider housing 60 with respect to the camshaft 30 is changed.

The camshaft 30 rotates around a center X and the cam 42 rotates around a changed rotation center Y1 relatively lower than the center X.

Since the rotation of the camshaft 30 is transmitted to the cam portion 40 through the connecting pin 34, the camshaft 30 and the cam 42 rotate with the same rotation speed.

Since the connecting pin 34 is slidable within the cam shaft hole 32 and the slider hole 82 and the pin slider 80 is rotatable within the pin hole 44, thus the cam 42 rotates around the changed rotation center Y1.

Since the relative rotation of the cam 42 is changed, the output portion 50 relatively rotates in a clockwise direction around the pivot shaft 52.

Since the output portion 50 relatively rotates in the clockwise direction around the pivot shaft 52, the contacting position of the valve shoe 54 to the swing arm roller 202 are changed to the right direction.

As shown FIG. 5 and in FIG. 6 for example, in low lift mode requiring low power, the slider housing 60 rotates in a counterclockwise direction around the pivot shaft 52 according to the operation of the control portion 100. Thus, the relative position of the slider housing 60 with respect to the camshaft 30 is changed.

The camshaft 30 rotates around a center X and the cam 42 rotates around a changed rotation center Y2 relatively higher than the center X.

Since the rotation of the camshaft 30 is transmitted to the cam portion 40 through the connecting pin 34, the camshaft 30 and the cam 42 rotate with the same rotation speed.

Since the connecting pin 34 is slidable within the cam shaft hole 32 and the slider hole 82 and the pin slider 80 is rotatable within the pin hole 44, thus the cam 42 rotates around the changed rotation center Y2.

Since the relative rotation of the cam 42 is changed, the output portion 50 relatively rotates in a counterclockwise direction around the pivot shaft 52.

Since the output portion 50 relatively rotates in the counterclockwise direction around the pivot shaft 52, the contacting position of the valve shoe 54 to the swing arm roller 202 are changed to the left direction.

In the various embodiments of the present invention, according to the relative position of the slider housing 60 with respect to the camshaft 30, the rotation center Y1 and Y2 of the cam 42 is changed and thus a contacting position of the output roller 56 and the cam 42 is changed. Thus, when the operation mode of the continuously variable valve lift apparatus is changed to the low lift mode, valve closing timing may be advanced.

Also, since the contacting position of the swing arm roller 202 and the valve shoe 54 is changed, the valve lift is adjusted.

A high lift profile A or a low lift profile B of the valve 204 may be performed according to the relative rotation center of the cam 42 with respect to the camshaft 30, relative positions of the camshaft 30 and the output roller 56 and the contacting position of the valve shoe 54 and the swing arm roller 202.

While only the high lift profile A and the low lift profile are shown in FIG. 7, however it is not limited thereto. The relative position of the slider housing 60 may perform various valve profiles.

As shown in FIG. 7, comparing to a valve duration C of a general continuously variable valve lift apparatus in the low lift mode, a valve duration D of the continuously variable valve lift apparatus according to various embodiments of the present invention may be reduced.

And valve closing time may be advanced comparing to valve closing time of the general continuously variable valve lift apparatus in the low lift mode due to contacting position change of the cam 42 and the output roller 56. Thus, pumping lose may be reduced and enhancement of fuel consumption may be realized.

Figure 8:
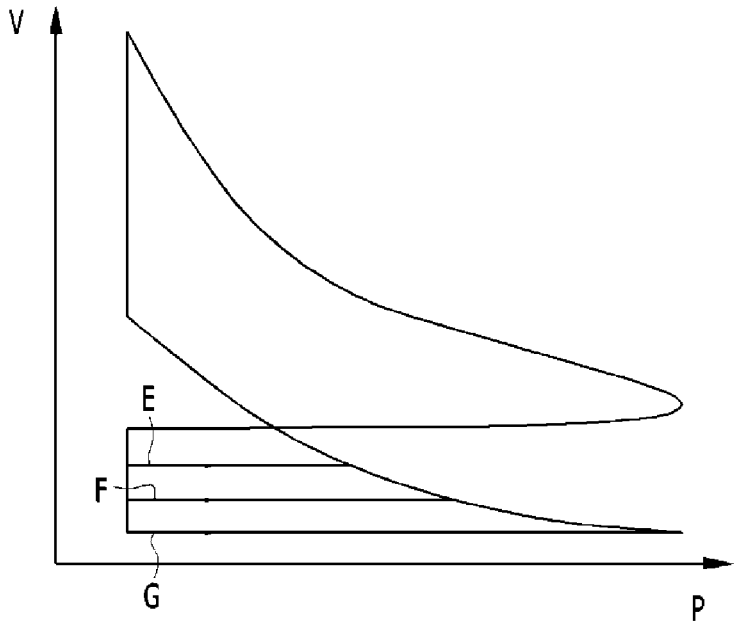
FIG. 8 is a graph of pressure volume diagram of an engine of the exemplary continuous variable valve lift apparatus according to the present invention.

FIG. 8 is a graph of pressure volume diagram of an engine.

As shown in FIG. 8, an engine provided with a continuous variable valve lift apparatus may reduce pumping loss F comparing to pumping loss E of an engine without a continuous variable valve lift apparatus.

However, the continuously variable valve lift apparatus may reduce valve duration and advance valve closing time so that may reduce pumping loss G and may enhance fuel economy.

The continuous variable valve lift apparatus according to various embodiments of the present invention may be reduced in size and thus the entire height of a valve train may be reduced.

Since the continuous variable valve lift apparatus may be applied to an existing engine without excessive modification, thus productivity may be enhance and production cost may be reduced.

In the various embodiments of the present invention, since valve lifts of two cams may be controlled using two cams and one slider housing, thus total numbers of elements may be reduced.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift apparatus comprising:

a camshaft;

a cam portion on which two cams are formed and on which a rotation member is formed between the two cams;

a slider housing into which the rotation member is rotatably inserted, and rotatable around a pivot shaft;

a control portion configured to selectively change a position of the slider housing;

an output portion contacting the two cams, rotatable around the pivot shaft and on which a valve shoe is formed; and a valve device configured to be driven by the valve shoe.

2. The continuously variable valve lift apparatus of claim 1, wherein the rotation member and the two cams of the cam portion are integrally formed.

3. The continuously variable valve lift apparatus of claim 1, wherein a camshaft hole is formed on the camshafts, wherein a pin hole is formed on the cam portion, and wherein the continuously variable valve lift apparatus further comprises:

a pin slider rotatably disposed within the pin hole and on which a slider hole is formed; and a connecting pin connected to the camshaft hole and slidably inserted into the slider hole.

4. The continuously variable valve lift apparatus of claim 1, further comprising a bearing inserted between the rotation member and the slider housing.

5. The continuously variable valve lift apparatus of claim 1, wherein:

the output portion is disposed as a pair; and the valve device is disposed as a pair and each valve device comprises a swing arm roller contacting each valve shoe.

6. The continuously variable valve lift apparatus of claim 5, wherein the output portion comprises an output roller contacting each cam of the two cams.

7. The continuously variable valve lift apparatus of claim 1, wherein the control portion comprises an eccentric shaft connected to the slider housing.

8. An engine comprising:

a camshaft;

a cam portion on which two cams are formed and on which a rotation member is formed between the two cams;

a slider housing into which the rotation member is rotatably inserted, and rotatable around a pivot shaft;

a control portion configured to selectively change a position of the slider housing;

an output portion contacting the two cams, rotatable around the pivot shaft and on which a valve shoe is formed; and a valve device configured to be driven by the valve shoe.

9. The engine of claim 8, wherein the rotation member and the two cams of the cam portion are integrally formed.

10. The engine of claim 8, wherein:

a camshaft hole is formed on the camshaft; and a pin hole is formed on the cam portion, wherein the continuously variable valve lift apparatus further comprises:

a pin slider rotatably disposed within the pin hole and on which a slider hole is formed; and a connecting pin connected to the camshaft hole and slidably inserted into the slider hole.

11. The engine of claim 8, further comprising a bearing inserted between the rotation member and the slider housing.

12. The engine of claim 8, wherein:

the output portion is disposed as a pair; and the valve device is disposed as a pair and each valve device comprises a swing arm roller contacting each valve shoe.

13. The engine of claim 12, wherein the output portion comprises an output roller contacting each cam of the two cams.

14. The engine of claim 8, wherein the control portion comprises an eccentric shaft connected to the slider housing.

* * * * *